US005615853A

United States Patent [19]

Hearst

[11] Patent Number: 5,615,853

[45] Date of Patent: Apr. 1, 1997

[54] BAG OPENING SUPPORT AND EXPANDER ASSEMBLY AND METHOD OF USE

[76] Inventor: Byirl J. Hearst, 28509 Everett Rd., Pueblo, Colo. 81006

[21] Appl. No.: 316,863

[22] Filed: Oct. 3, 1994

[51] Int. Cl.[6] ..... B65B 67/04

[52] U.S. Cl. ..... 248/99; 248/156

[58] Field of Search ..... 224/202, 205, 224/254, 257, 258, 268, 271; 294/1.1; 248/100, 99, 95, 101, 153, 156, 97; 124/23.1

[56] References Cited

U.S. PATENT DOCUMENTS

| | | | |
|---|---|---|---|
| 1,848,768 | 3/1932 | Cowdery | 124/23.1 |
| 2,718,988 | 9/1955 | Potts | 224/202 |
| 3,796,402 | 3/1974 | Trotta | 248/156 |
| 3,934,803 | 1/1976 | Paulus | 294/1.1 |
| 3,998,415 | 12/1976 | D'Antonio | 294/1.1 |
| 4,550,440 | 10/1985 | Rico | 248/99 |
| 4,699,415 | 10/1987 | Skovajsa | 224/257 |
| 5,183,339 | 2/1993 | Williams | 294/1.1 |

*Primary Examiner*—Ko Chan
*Assistant Examiner*—Gwendolyn Wrenn
*Attorney, Agent, or Firm*—Phillip A. Rein

[57] ABSTRACT

A bag opening support and expander assembly is provided having a flexible support body member capable of being bent and retained in an arcuate form by an adjustable, flexible tension and connector member or means. The bag opening support and expander assembly is operable to support and retain an open end section of a flexible refuse bag member facilitating inserting of refuse material. A variety of support means are provided including elements for receiving and supporting the bag opening support and expander assembly and interconnected open end section in a generally elevated horizontal condition while supporting the bag member in a downwardly depending condition.

12 Claims, 4 Drawing Sheets

BAG OPENING SUPPORT AND EXPANDER ASSEMBLY AND METHOD OF USE

PRIOR ART

A patent search was not conducted on this invention. A Disclosure Document has been filed in the United States Patent Office being Document No. 354,327, filed May 6, 1994.

PREFERRED EMBODIMENT OF THE INVENTION

In one preferred embodiment of this invention, a bag opening support and expander assembly and method of use is provided having a flexible support body member capable of being bent and retained in an arcuate form by an adjustable tension and connector member or means (similar to a rope or cord) and is operable to support an open end section of a plastic trash bag member facilitating insertion of refuse material therein.

The support body member is provided with an anchor end section integral with a main body portion which, in turn, is integral with an adjustable end section. The anchor end section comprises an angled portion having a retainer hole through which an anchor end portion of the tension and connector member is inserted.

The adjustable end section of the support body member includes an angled portion having two adjacent connector holes of design such that when a free end portion of the tension and connector member is inserted through one connector hole and then passed through the other connector hole, the resulting interaction of the tension and connector member in the two connector holes provides a locking means having adequate friction so as to prevent retreat of the tension and connector member.

The tension and connector member comprises the free end portion interconnected to the anchor end portion by a connector and support portion or main body. The anchor end portion is tied into a knot providing an anchor allowing passage in only one direction of the tension and connector member through the retainer hole in the anchor end section of the support body member.

The free end portion of the tension and connector member is operable to be pulled in one direction through the two adjacent connector holes to bend the support body member into an arcuate or semi-circular shape for insertion into an entrance opening of the plastic bag member. Next, the free end portion can be moved in an opposite direction in the two adjacent connector holes to expand the support body member. The expanded support body member contacts and supports the bag member in an open condition to easily receive the refuse material therein.

In further embodiments of the methods of use, the bag opening support and expander assembly is provided with support elements providing support and horizontal orientation of the invention through means consisting essentially of 1) a shaft support member being a vertical post having a) a support end section with a receiver slot to accept and support the support body member; and b) a tapered end section operable by forcing the tapered end section directly into a support surface such as a lawn; 2) a stabilizer member being a U-shaped frame member having a vertical receiver sleeve portion providing support for the shaft support member; 3) a support clip member being generally S-shaped having a bag expander support portion capable of supporting the support body member in a horizontal aspect and a clip attachment portion attachable to a rim of a rigid container such as a garbage can; and 4) a conveyance and wall mount adapter assembly consisting of a pair of support clip members and a strap member. The support clip member is of J-shape having a bag expander support section capable of supporting the support body member in a horizontal aspect and a connector end section having a slot opening and a wall mount opening operable either as: a) a single support clip member fastened to a vertical surface such as a wall by means of a wall mount fastener secured through the wall mount opening; or b) a pair of support clip members interconnected by the strap member passed through the slot openings. The strap member allows conveyance by a user supporting the bag opening support and expander assembly and interconnected trash bag on its shoulder.

OBJECTS OF THE INVENTION

One object of this ! invention is to provide a bag opening support and expander assembly allowing an open end section of a bag member to be supported and retained in an open condition.

Another object of this invention is to provide a bag opening support and expander assembly providing a stiff, semi-circular opening to a bag member allowing the straight portion to be placed on a support surface such as a floor or lawn facilitating the pushing, sweeping, or raking of refuse or other material into the bag member.

One other object of this invention is to provide a bag opening support and expander assembly having a flexible support body member of sufficient stiffness so that, when inserted and expanded in an open end section of a flexible bag member, the outward force causes frictional interaction with the bag member to hold the bag member in an open condition for ease of inserting refuse material therein.

One further object of this invention is to provide a bag opening support and expander assembly including a support body member arcuately adjustable by means of a tension and connector member adjustably attached at one end and anchored at another end of the support body member.

Another object of this invention is to provide a bag opening support and expander assembly having a thin, flat support body member such that an entrance opening to an interconnected bag member can be supported in a horizontal plane when supported at a single point on the support body member.

One other object of this invention is to provide a bag opening support and expander assembly easily adapted to use with bag members of differing size.

A further object of this invention is to provide a bag opening support and expander assembly adaptable for use with a refuse container by means of a support element connected to a support body member such that an entrance opening of a bag member is horizontally oriented above a support surface with a main body section of the bag member extending downward.

Still, one other object of this invention is to provide a bag opening support and expander assembly which is versatile in application; simple to use; economical to manufacture; and attractive in appearance.

Various other objects, advantages, and features of the invention will become apparent to those skilled in the art from the following discussion, taken in conjunction with the accompanying drawings, in which:

FIGURES OF THE INVENTION

Figure 1:
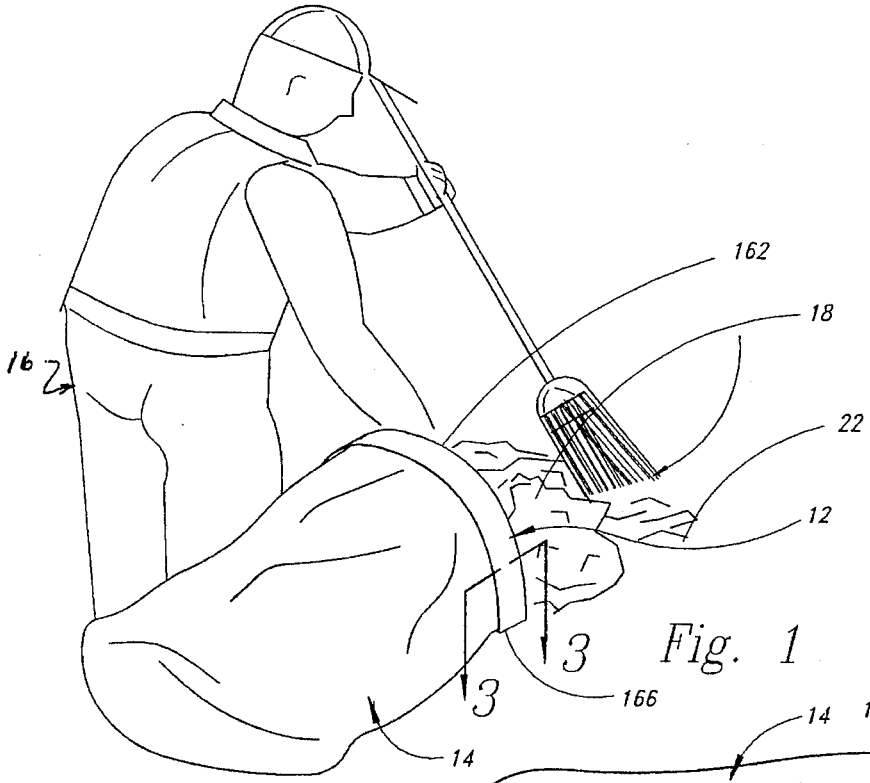
FIG. 1 is a perspective view of a bag opening support and expander assembly of this invention connected to a bag member and illustrating a method of use in collecting refuse material by a user.

The following is a discussion and description of preferred specific embodiments of the bag opening support and expander assembly and method of use of this invention, such being made with reference to the drawings, whereupon the same reference numerals are used to indicate the same or similar parts and/or structure. It is to be understood that such discussion and description is not to unduly limit the scope of the invention.

DESCRIPTION OF THE INVENTION

Referring to the drawings in detail, and in particular to FIG. 1, a bag opening support and expander assembly of this invention, indicated generally at 12, is utilized with a bag member 14 and placed on a support surface 22 allowing a user 16 to push refuse material 18 into the bag member 14.

Figure 2:
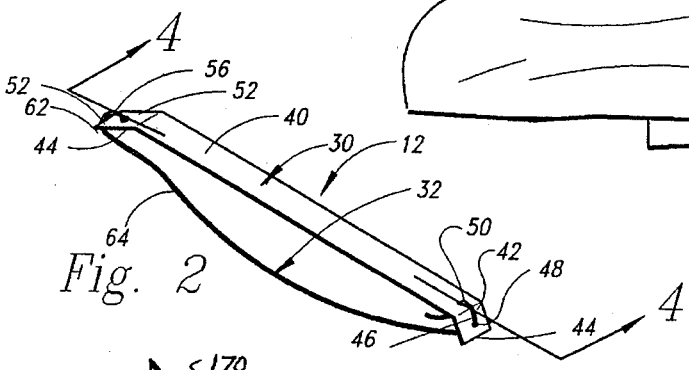
FIG. 2 is a perspective view of the invention.

As depicted in FIG. 2, the bag opening support and expander assembly 12 comprises a long, thin, flexible, support body member 30 being adjustably connected at each end to a tension and connector member or means 32.

Figure 4:
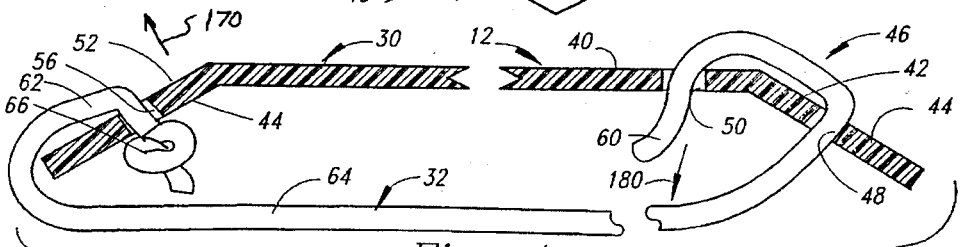
FIG. 4 is an enlarged fragmentary foreshortened sectional view taken along line 4—4 in FIG. 2.

As best shown in FIG. 4, the support body member 30 is constructed of an adjustable end section 42 interconnected to an anchor end section 52 by a main body portion 40. The adjustable end section 42 includes an angled portion 44 having an integral locking means 46.

The locking means 46 is comprised of a first connector hole or opening 48 placed in the angled portion 44 and an adjacent second connector hole or opening 50 in the main body portion 40. The tension and connector member 32 is passed through the first connector hole or opening 48 and then, in an opposite direction, through the second connector hole or opening 50. Both connector holes 48 and 50 are of a diameter slightly larger than that of the tension and connector member 32 such that, when coupled with the described routing of the tension and connector member 32 through the connector holes 48 and 50, adequate friction to prevent unintended longitudinal movement of the tension and connector member 32 is accomplished.

At the opposite end of the main body portion 40 from the adjustable end section 42 is the anchor end section 52. The anchor end section 52 includes an angled portion 44 with a retainer hole 56 centered therein.

The tension and connector member 32 is preferably constructed of rode or cord, though other material, such as a flat, web strap, would be adequate. The length of the tension and connector member 32 is no less than that of the support body member 30 as shown in FIG. 2. The tension and connector member 32 includes a free end portion 60 interconnected to an anchor end portion 62 by a connector and support portion 64.

As illustrated in FIG. 4, the anchor end portion 62 terminates in an anchor 66 which, when the anchor end portion 62 has been inserted through the retainer hole 56 formed into a knot and slack removed, abuts the anchor end section 52 and thereby prevents movement of the tension and connector member 32 in one direction.

The bag opening support and expander assembly 12 allows a bag member 14 to be adapted for use in several different applications by employing various support elements or means 34. The support means 34 includes: 1) a shaft support member 68 operable to support the bag opening support and expander assembly in a horizontal, raised position when inserted directly into a support surface 22 or used in conjunction with a stabilizer frame 82; 2) a support clip member 94 being S-shaped allowing the bag opening support and expander assembly 12 to be suspended from a rim 101 of a rigid container member 24; and 3) a conveyance and wall mount adapter assembly 106 including a support clip member 110 providing means for permanent vertical surface mounting or, when used with a strap member 108 and a second support clip member 110, a means to convey the bag opening support and expander assembly 12 over a shoulder 20 of the user 16.

Figure 8:
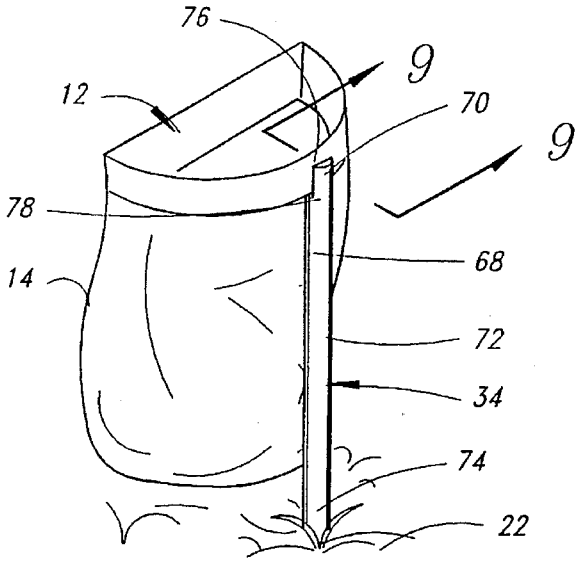
FIG. 8 is a perspective view of the invention horizontally supported by a shaft support member.

As illustrated in FIG. 8, the shaft support member 68 includes a support end section 70 interconnected to an end support section 74 by a main body section 72. The end support section 74 includes a tapered end portion 80 allowing the shaft support member 68 to be inserted into a support surface 22 such as a lawn as clearly shown in FIG. 9.

Figure 9:
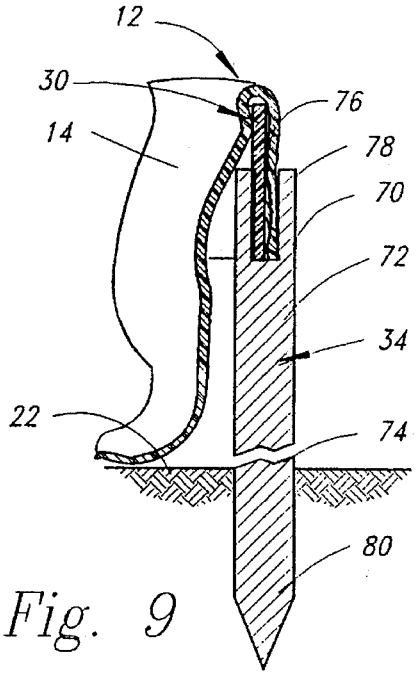
FIG. 9 is an enlarged, foreshortened sectional view taken along line 9—9 in FIG. 8.

Still referring to FIG. 9, the support body member 30 is of flat material allowing the bag opening support and expander assembly 12 to be supported horizontally by inserting a portion of the support body member 30 into a receiver slot 76 formed between two parallel adjacent support wall sections 78. A bottom wall of the bag member 14 is supported on the support surface 22 providing counter balance preventing tipping and dislodging.

Figure 10:
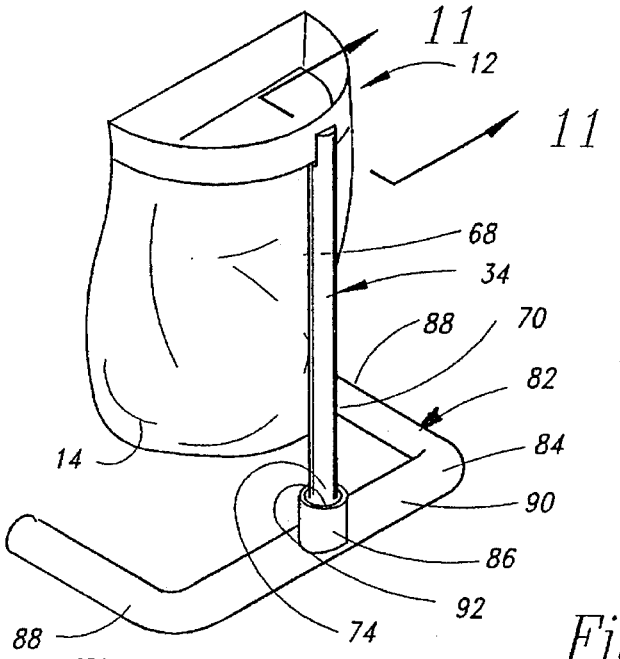
FIG. 10 is a perspective view of the invention horizontally supported by the shaft support member inserted in a stabilizer member.
Figure 11:
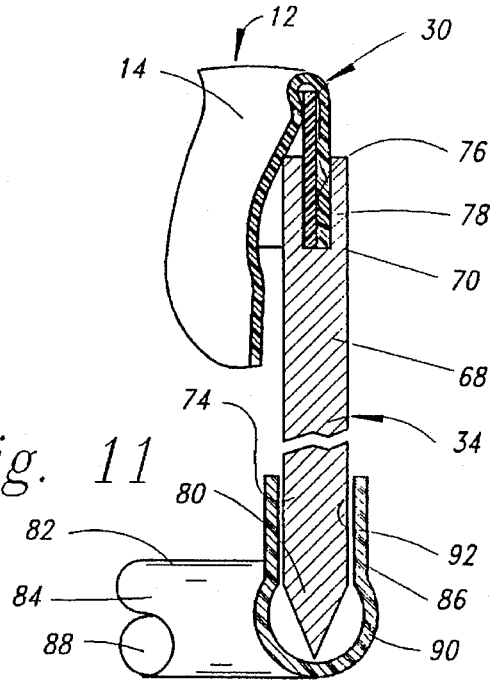
FIG. 11 is an enlarged, foreshortened sectional view taken along line 11—11 in FIG. 10.

As an alternative to impaling the shaft support member 68 into the support surface 22, a stabilizer member 82 is used as shown in FIG. 10. The stabilizer member 82 comprises a U-shaped frame member 84 having two parallel leg member 88 perpendicularly adjoined at adjacent ends by a connector member 90. The connector member 90 has, at its mid point, a laterally extended receiver sleeve portion 86 having a shaft support opening 92. As shown in FIG. 11, the shaft support opening 92 is of a diameter such that it forms a snug fit with the end support section 74 of the shaft support member 68 when inserted therein.

Figure 13:
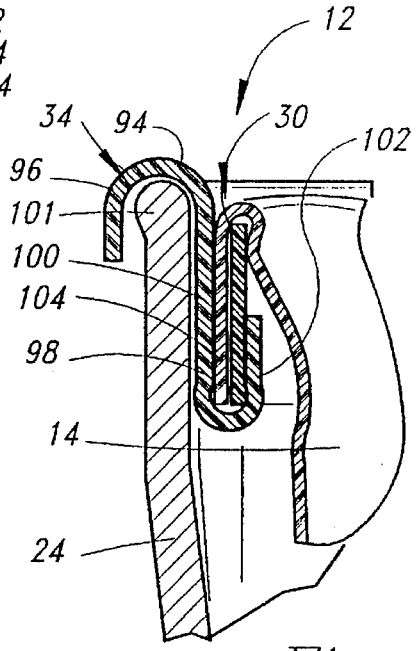
FIG. 13 is an enlarged, fragmentary sectional view taken along line 13—13 in FIG. 12.

Referring to FIG. 13, the support clip member 94 is generally S-shaped including a clip attachment portion 96 interconnected to a bag expander support portion 98 by an intermediate support portion 100. The clip attachment portion 96 is designed to engage and be supported on the rim 101 of the rigid container member 24.

The bag expander support portion 98 includes a body support slot 104 vertically formed between an end wall section 102 being parallel to the intermediate support portion 100. The support body member 30 is of flat material allowing the bag opening support and expander assembly 12 to be supported horizontally by inserting the support body member 30 into the body support slot 104.

Referring to FIG.'S 14 & 15, the conveyance and wall mount adapter assembly 106 includes a J-shaped support clip member 110 operable independently as a wall mounted support member or in a pair of support clip members 110 interconnected by a strap member 108 as a conveyance support assembly.

The support clip member 110 includes a connector end section 118 interconnected to a bag expander support portion 98 by a clip main body section 122. The bag expander support portion 98 is identical in design and function to the bag expander support portion 98 referenced as part of the aforementioned support clip member 94 (FIG. 13).

Figure 15:
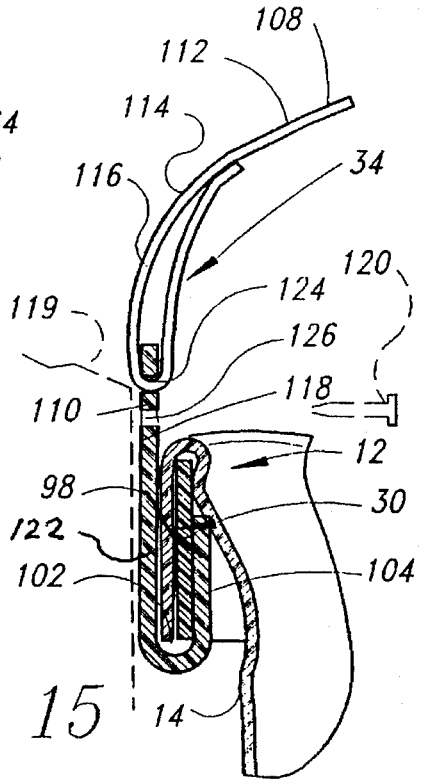
FIG. 15 is an enlarged, fragmentary sectional view taken along line 15—15 in FIG. 14.

As best shown in FIG. 15, the connector end section 118 includes a strap attachment slot 124 and a wall mount opening 126. A wall mount fastener 120 can be inserted through the wall mount opening 126 providing attachment to a wall 119 or other vertical surface.

Figure 14:
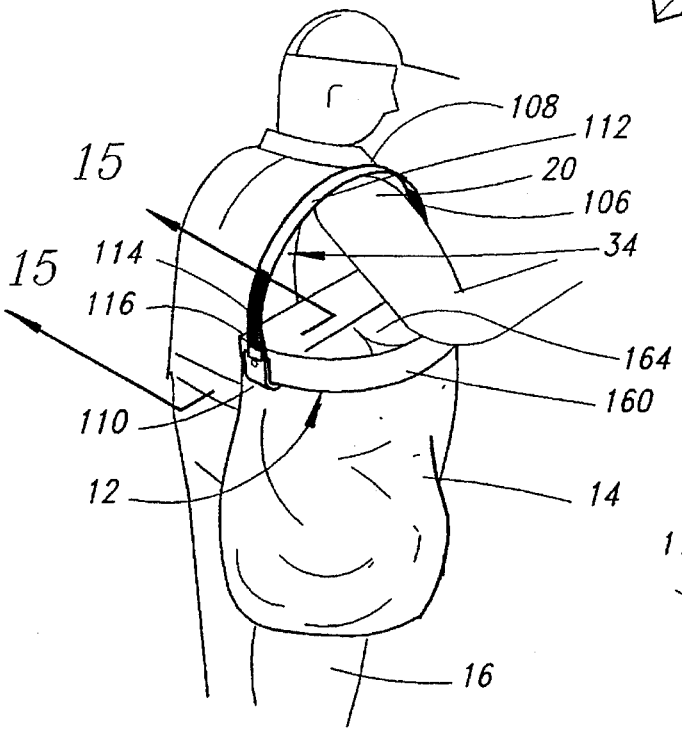
FIG. 14 is a perspective view of the invention supported by a conveyance and wall mount adapter assembly on a shoulder of a user thereof.

The strap member 108 is constructed of two connector end sections 114 interconnected by a support body section 112. The connector end sections 114 are passed through the respective strap attachment slots 124 of the support clip members 110 and secured in an enclosed loop portion 116 allowing the bag opening support and expander assembly 12 to be supported on the shoulder 20 of the user 16 as shown in FIG. 14.

USE AND OPERATION OF THE INVENTION

The bag opening support and expander assembly 12 of this invention is first prepared by attaching the tension and connector member 32 to the support body member 30.

The tension and connector member 32 is illustrated as having the anchor end portion 62 inserted through the retainer hole 56 and formed into the anchor 66, preferably a knot, to prevent movement in the direction noted by an arrow 170.

The adjustable end section 42 comprises the angled portion 44 with the free end portion 60 of the tension and connector member 32 trained through the first connector hole or opening 48 and the second connector hole or opening 50 as shown in FIG. 4.

Figure 5:
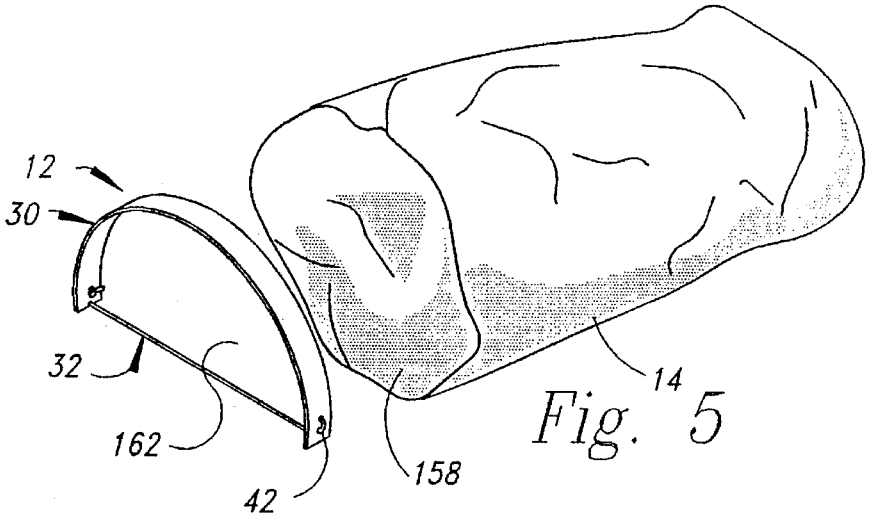
FIG. 5 is a perspective view of the invention enabled for deployment about an entrance opening of a bag member.

To assemble the bag opening support and expander assembly 12, the support body member 30 is situated parallel to a support surface 22 such that the angled portions 44 extend downwardly toward the support surface 22 as shown in FIG. 4. The free end portion 60 of the tension and connector member 32 is passed upwardly through the retainer hole 56 until further passage is impeded by the anchor or knot 66. The tension and connector member 32 is wrapped over an outer edge of the anchor end section 52, being now positioned beneath the support body member 30. The free end portion 60 of the tension and connector member 32 is passed upwards through the first connector hole or opening 48 and then downwards through the second connector hole or opening 50. Pulling the free end portion 60 in the direction of arrow 180 in FIG. 4 shortens a formed chord length of the connector and support portion 64 thereby forcing the support body member 30 into a stressed, semi-circular opening 162 slightly smaller in perimeter than that of an open end section 158 of the bag member 14 as shown in FIG. 5.

Figure 6:
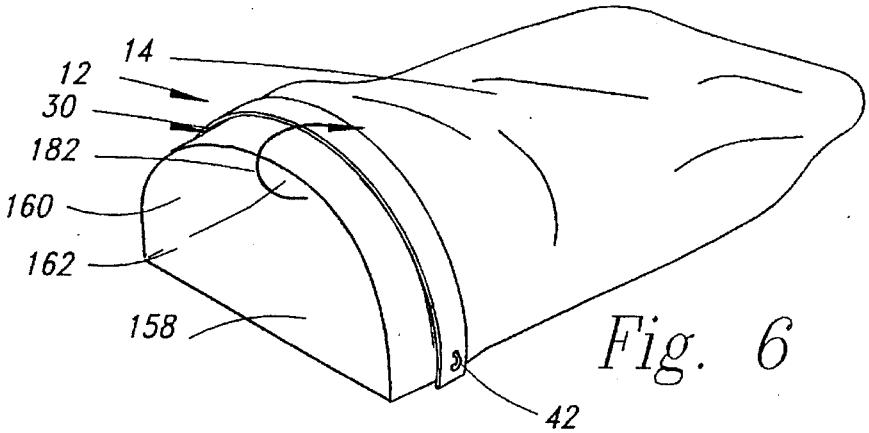
FIG. 6 is a view similar to FIG. 5 showing the bag member inserted through a semi-circular opening formed by the invention.
Figure 7:
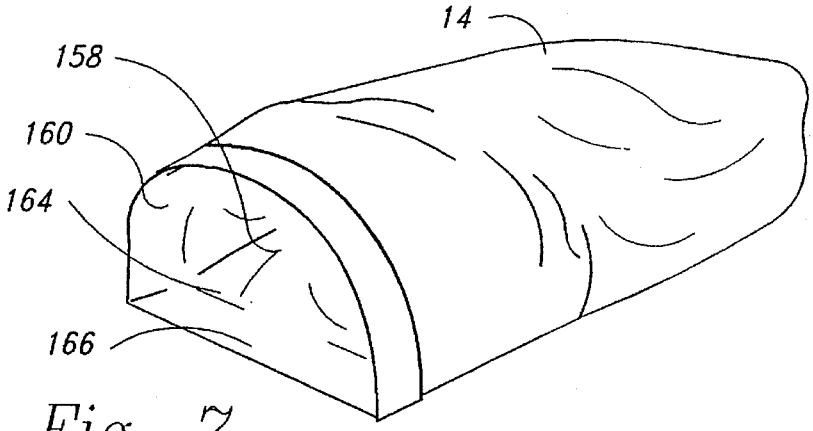
FIG. 7 is a view similar to FIG. 6 and depicts the bag member folded over the invention which has been expanded and ready for use.

As illustrated in FIG. 6, the open end section 158 of the bag member 14 is then passed through the semi-circular opening 162 of the bag opening support and expander assembly 12, forming a folded cuff section 160. The folded cuff section 160 is folded outwardly backwards as indicated by an arrow 182. Tension on the tension and connector member 32 is relieved by allowing the free end portion 60 to retreat through the locking means 46 (connector holes 48 and 50) until the support body member 30 expands the open end section 158 of the bag member 14 forming a smooth, taut, semi-circular bag opening 164 as shown in FIG. 7.

Referring to FIG. 1, the use 16 can support the bag opening support and expander assembly 12 perpendicularly to a support surface 22 aligning the semi-circular bag opening 164 having a straight portion 166 along the support surface 22. The user 16 can then, using a free hand, sweep or otherwise insert refuse material 18 into the bag member 14.

Figure 12:
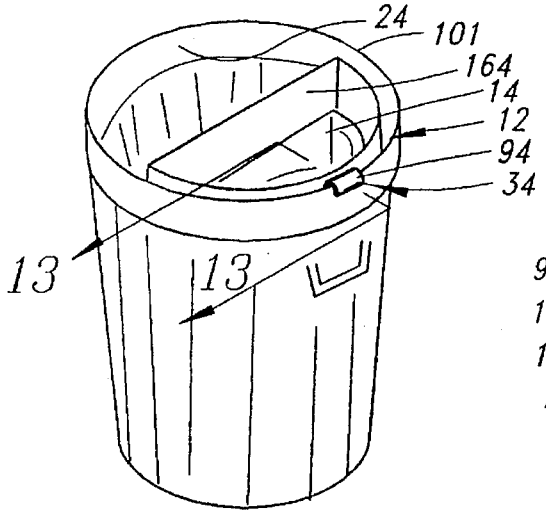
FIG. 12 is a perspective view of the invention horizontally supported by a support clip member in a rigid container member.

The support means 34 can be used adapting the bag opening support and expander assembly 12 to be supported in a raised, horizontal position with the bag member 14 extended downwardly. The support means 34 includes 1) the shaft support member 68 being a post-like support that can be inserted either a) directly into a support surface 22 such as a lawn as shown in FIG. 9; or b) inserted into the receiver sleeve portion 86 of the stabilizer member 82 as shown in FIG. 10; 2) the support clip member 110 mounted on the rim 101 of the rigid container member 24 as shown in FIG. 12; and 3) a conveyance and wall mount adapter assembly 106 having the strap member 108 connected at opposite ends to a respective support clip member 110 with the support clip member 110 being adaptable to be independently fastened by a fastener member 120 to a wall 119 or other vertical surface.

The stabilizer member 82 provides an alternative to inserting the shaft support member 68 into a support surface 22 as illustrated in FIG. 9. The stabilizer member 82 includes the U-shaped frame member 84 having the two parallel leg members 88 perpendicularly adjoined at adjacent ends by a connector member 90. The connector member 90 has the receiver sleeve portion 96 with the shaft support opening 92 to accommodate the end support section 74 when inserted therein as noted in FIG. 11.

Referring to FIG.'S 12 & 13, the support clip member 94 is designed to support the interconnected bag opening support and expander assembly 12 and interconnected bag member 14 which is then supported on the rim 101 of the rigid container member 24.

Referring to FIG.'S 14 & 15, the conveyance and wall mount adapter assembly 106 includes the J-shaped support clip member 110 operable independently as a wall mounted support member or with a pair of the support clip members 110 interconnected by the strap member 108 as a conveyance support assembly.

As illustrated in FIG. 15, the connector end section 118 includes the strap attachment slot 124 and the wall mount opening 126. The wall mount fastener 120 can be inserted through the wall mount opening 126 providing attachment to the wall 119 or other vertical surface as shown in dotted lines.

The strap member 108 includes two connector end sections 114 passed through respective strap attachment slots 124 of the support clip members 110 and secured in an enclosed loop portion 116 allowing the bag opening support and expander assembly 12 to be supported on the shoulder 20 of the user 16 as shown in FIG. 14.

Figure 3:
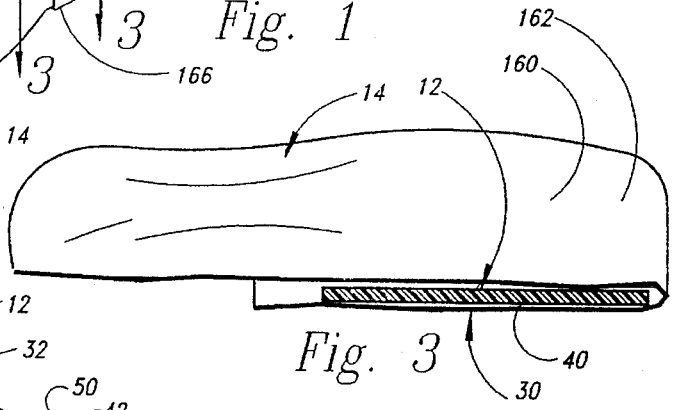
FIG. 3 is an enlarged fragmentary sectional view taken along line 3—3 in FIG. 1.

In the method of use of the bag opening support and expander assembly 12 of this invention, the following steps are noted:

1) connecting the tension and connector member 32 to the support body member 30 as shown in FIG. 2;
2) pulling the free end portion 60 of the tension and connector member 32 through the connector holes 48 and 50 to achieve a desired arcuate support body member 30 as shown in FIG. 3;
3) pulling the bag member 14 through the semi-circular opening 162 formed by the bag opening support and expander assembly 12 as noted in FIG. 6;
4) folding the folded cuff section 160 of the bag member 14 over the bag opening support and expander assembly 12 as noted in FIG. 7; and
5) releasing tension on the tension and connector member 32 to apply pressure against the folded cuff section 160 to hold the open end section 158 of the bag member 14 for ease of collecting refuse material therein as shown in FIG. 1.

On use of the support means 34, the following method steps are noted:

1) connecting a portion of the support body member 30 to the shaft support member 68 which can be a) inserted in the lawn surface 22 or b) connected to the stabilizer member 82 to hold the open end section 158 of the bag member 14 in a horizontal plane;
2) connecting the support clip member 94 to a portion of the support body member 30 and the container rim 101 of the rigid container member 22 to hold the open end section 158 of the bag member 14 in a horizontal plane and supported in the container member 22;
3) connecting the support clip member 110 to a portion of the support body member 30 and anchoring the support clip member 110 to a vertical support wall; and
4) connecting a pair of the support clip members 110 to the strap member 108 and connecting the support clip members 110 to opposed portions of the support body member 30 and supporting the strap member 108 on a shoulder portion of a user 16 thereof for ease of conveyance.

The support clip member 94 can be attached to a central portion of the support body member 30 when used to collect refuse material into the bag member 14 as shown in FIG. 1. The spacing between the clip attachment portion 96 and the intermediate support portion 100 acts as a handle for ease of conveyance and horizontal movement of the support body member 30 and attached bag member 14.

The bag opening support and expander assembly includes a support body member with attached tension and connector member which is easy to operate; economical to manufacture; adaptable to differing sized bag members; and versatile in usage with the support means.

While the invention has been described in conjunction with preferred specific embodiments thereof, it will be understood that this description is intended to illustrate and not to limit the scope of the invention, which is defined by the following claim:

I claim:

1. A bag opening support and expander assembly operable to engage and support an open end section of a bag member and hold in semi-circular shape, comprising:

a) a flexible support body member including outer end sections;

b) one of said outer end sections having a pair of adjacent connector holes;

c) a flexible tension and connector member having one end trained through said connector holes and a opposite end secured to another one of said outer end sections;

d) said one end of said flexible tension and connector member moved in one direction in said connector holes to cause bending of said support body member and movement of said outer end sections toward each other to form an arcuate shape to be mounted within the open end section of the bag member;

e) after bending said support body member to said arcuate shape, said support body member and interconnected flexible tension and connector member are inserted into said open end section of said bag member;

f) said open end section is folded over said support body member and said flexible tension and connector member to form a folded cuff section; and g) said one end of said flexible tension and connector member is movable in minute continuous increments in an opposite direction in said one of said outer end sections to decrease tension on said flexible tension and connector member and concurrently increase an arch of said support body member to apply pressure against an inside surface of said folded cuff section to hold said open end section of said bag member in the open position.

2. A bag opening support and expander assembly as described in claim 1, including:

a) a support means including a conveyance and wall mount adapter assembly having a strap member with a support body section connected at each outer end by means of an enclosed loop portion to a support clip member;

b) said support clip member having a connector end section interconnected to a bag expander support portion by a clip main body section;

c) said connector end section includes an integrally formed strap attachment slot through which said enclosed loop portion of said strap member is secured; and d) said bag expander support portion having a support body slot to receive and support said support body member therein;

whereby said strap member is placed on a shoulder portion of a user while holding said support body member in a horizontal plane for ease of usage.

3. A bag opening support and expander assembly as described in claim 1, including:

a) a support means having a support clip member;

b) said support clip member including a connector end section integral with a clip main body section which, in turn, is integral with a bag expander support section;

c) said bag expander support section and said clip main body section forming a support body slot therebetween to receive and support said support body member therein; and d) said connector end section having a wall mount opening operable to receive a wall mount fastener therein for securing to a support wall surface.

4. A bag opening support and expander assembly as described in claim 1, wherein:

a) said flexible tension and connector member is a cord member.

5. A bag opening support and expander assembly operable to engage and hold an open end section of a bag member in an open position for ease of adding refuse material therein, comprising:

a) a support body member including a main body section interconnecting an outer adjustable end section and an outer anchor end section;

b) a connector means being a flexible cord member interconnecting said outer adjustable end section and said outer anchor end section;

c) one end of said connector means movable transversely of said outer adjuster end section in one direction to cause bending of said support body member from a generally flat position toward an arcuate shape which can be inserted within the open end section of the bag member for holding in the open position;

d) after bending said support body member to said arcuate shape, said support body member and interconnected said connector means are inserted into said open end section of said bag member;

e) said open end section is folded over said support body member and said connector means to form a folded cuff section; and f) said one end of said connector means is movable in minute continuous increments in an opposite direction in said outer adjustable end section to decrease tension on said connector means and concurrently increase an arch of said support body member to apply pressure against an inside surface of said folded cuff section to hold said open end section of said bag member in the open position.

6. A bag opening support and expander assembly as described in claim 5, wherein:

a) said connector means includes an outer free end portion and an outer anchor end portion; and b) said outer anchor end portion connected to said outer anchor end section and held against movement on tensioning of said connector means during bending to the arcuate shape.

7. A bag opening support and expander assembly as described in claim 6, wherein:

a) said outer adjustable end section having a first connector hole and a second connector hole;

b) said free end portion trained through said first connector hole and said second connector hole; and c) frictional contact of said connector means with said first connector hole, said second connector hole, and a portion of said support body member to prevent axial movement of said connector means after bending of said support body member to a desired said arcuate shape.

8. A bag opening support and expander assembly as described in claim 5, wherein:

a) said outer adjustable end section and said anchor end section each having an angled portion extended in a same direction laterally of said main body section;

b) said outer anchor end section having a retainer hole to receive an anchor end portion of said connector means therethrough;

c) said anchor end portion formed into a knot to prevent movement thereof through said retainer hole in said one direction;

d) said outer adjustable end section having adjacent connector holes to receive said one end of said connector means therethrough; and e) said one end trained through one of said connector holes in one direction and through another of said connector holes in an opposite direction to achieve frictional contact with said connector holes and a portion of an outer surface of said support body member to prevent unintended movement of said connector means after bending said support body member to said an arcuate shape.

9. A bag opening support and expander assembly as described in claim 5, including:

a) a support means having a support clip member;

b) said support clip member including a connector end section integral with a clip main body section which, in turn, is integral with a bag expander support section forming a support body slot therebetween to receive and support a support body member therein; and c) said connector end section having a wall mount opening operable to receive a wall mount fastener therein for securing to a support wall surface.

10. A method of expanding and supporting an open end section of a bag member with use of a bag opening and expander assembly having a flexible support body member connected to a tension and connector member operable for ease of receiving refuse material in the bag member, comprising the steps of:

a) attaching one end of said tension and connector member permanently to one end of said support body member;

b) connecting another end of said tension and connector member adjustably to a remaining end of said support body member;

c) bending said support body member constructed of flexible resilient material on movement in selective minute increments of said tension and connector member in one direction against a spring bias of said support body member into a first arcuate shape by moving said one end of said flexible tension and connector member in one direction in said connector holes;

d) inserting said support body member of said first arcuate shape into an open end section of the bag member such that an adjacent plane of said first arcuate shape is parallel with the plane of the open end section;

e) folding the open end section of the bag member over said support body member forming a folded cuff section; and f) moving said tension and connector member in small continuous increments in an opposite direction which expands said support body member to lessen the spring bias to engage and tension the open end section of the bag member forming a larger second arcuate shape.

11. A method of expanding and supporting an open end section of a bag member as described in claim 10, wherein:

a) placing said support body member perpendicularly to a support surface such that a straight cord of said second arcuate shape contacts and is being supported on the support surface; and b) sweeping or pushing the refuse material into the bag member.

12. A method of expanding and supporting an open end section of a bag member as described in claim 10, including:

a) connecting said support body member and interconnected bag member to a support clip member having a wall mount opening; and b) securing said support clip member to a support surface by a fastener member extended through said wall mount opening and positioning said support body member in a horizontal plane with the bag member downwardly depending therefrom.

* * * * *